US008210710B2

(12) United States Patent
Koch et al.

(10) Patent No.: US 8,210,710 B2
(45) Date of Patent: Jul. 3, 2012

(54) MULTI-FUNCTIONAL FLASHLIGHT

(75) Inventors: Greg W. Koch, Kaysville, UT (US); Bruce K. Bangerter, Bountiful, UT (US); Kevin E. Collier, Kaysville, UT (US); Darrell B. Steinicke, Bountiful, UT (US)

(73) Assignee: Mag Instrument, Inc., Ontario, CA (US)

( * ) Notice: Subject to any disclaimer, the term of this patent is extended or adjusted under 35 U.S.C. 154(b) by 102 days.

(21) Appl. No.: 12/971,686

(22) Filed: Dec. 17, 2010

(65) Prior Publication Data

US 2011/0096538 A1 Apr. 28, 2011

Related U.S. Application Data

(63) Continuation of application No. 12/510,090, filed on Jul. 27, 2009, and a continuation of application No. 12/509,628, filed on Jul. 27, 2009, now abandoned, which is a continuation of application No. 11/520,051, filed on Sep. 11, 2006, now Pat. No. 7,566,149, which is a continuation of application No. 10/460,047, filed on Jun. 12, 2003, now Pat. No. 7,125,140, which is a continuation of application No. 09/583,349, filed on May 31, 2000, now Pat. No. 6,585,391.

(51) Int. Cl.
*F21L 4/04* (2006.01)

(52) U.S. Cl. ..... 362/205; 362/204; 362/202; 200/60

(58) Field of Classification Search ..... 362/208, 362/802, 205, 204; 200/512, 517
See application file for complete search history.

(56) References Cited

U.S. PATENT DOCUMENTS

| | | | |
|---|---|---|---|
| 2,876,410 | A | 3/1959 | Fry |
| 3,521,050 | A | 7/1970 | Shagena, Jr. |
| 4,092,580 | A | 5/1978 | Prinsze |
| 4,171,534 | A | 10/1979 | Strowe |
| 4,203,150 | A | 5/1980 | Shamlian |
| 4,268,311 | A | 5/1981 | VerDow |

(Continued)

FOREIGN PATENT DOCUMENTS

WO 00/22890 4/2000

OTHER PUBLICATIONS

McGill Electric Switch, Thermodisc.

(Continued)

*Primary Examiner* — Anabel Ton
(74) *Attorney, Agent, or Firm* — Schlee IP International, P.C.; Alexander R. Schlee

(57) ABSTRACT

A flashlight is described holding at least one battery and an illumination source. A circuit interruption and completion device is provided forming a complete circuit between the illumination source and the battery, when the device is in a closed mode. The device comprises a switch which is manually actuated between at least a first position which causes the device to enter the closed mode and a second position. A switch holding structure comprises a member with means for making an electrical connection associated with the member; and at least one conductive spring is attached to the member to make electrical contact with the means for making an electrical connection with the battery. The switch controls multiple functions of the flashlight including a strobe and a momentary mode. A pushbutton switch may control the multiple functions by multiple pushes on the switch.

59 Claims, 3 Drawing Sheets

U.S. PATENT DOCUMENTS

| | | | | |
|---|---|---|---|---|
| 4,327,401 | A | 4/1982 | Siiberg | |
| 4,357,648 | A | 11/1982 | Nelson | |
| 4,388,673 | A | 6/1983 | Maglica | |
| 4,495,551 | A | 1/1985 | Foltz | |
| 4,577,263 | A | 3/1986 | Maglica | |
| 4,754,106 | A | 6/1988 | Walker | |
| 4,803,316 | A | 2/1989 | Hayashi et al. | |
| 4,843,526 | A | 6/1989 | Price, III | |
| 4,914,555 | A | 4/1990 | Gammache | |
| 4,959,637 | A | 9/1990 | Woods et al. | |
| 4,999,750 | A | 3/1991 | Gammache | |
| 5,066,841 | A | 11/1991 | Zoller et al. | |
| 5,424,516 | A | 6/1995 | Emmons | |
| 5,426,273 | A | 6/1995 | Shiau | |
| 5,485,360 | A | 1/1996 | Maglica | |
| 5,486,432 | A | 1/1996 | Sharrah et al. | |
| 5,560,705 | A | 10/1996 | Shiau | |
| 5,578,992 | A | 11/1996 | Harding | |
| 5,598,082 | A | 1/1997 | Gilpin et al. | |
| 5,655,650 | A | 8/1997 | Naitou | |
| 5,859,506 | A | 1/1999 | Lemke | |
| 5,865,525 | A | 2/1999 | Kibler et al. | |
| 5,931,562 | A | 8/1999 | Arato | |
| 6,045,237 | A | 4/2000 | Parsons et al. | |
| 6,074,072 | A | 6/2000 | Parsons et al. | |
| 6,079,847 | A | 6/2000 | Nelson | |
| 6,190,020 | B1 | 2/2001 | Hartley | |
| 6,249,089 | B1 | 6/2001 | Bruwer | |
| 6,269,367 | B1 | 7/2001 | Travis et al. | |
| 6,283,609 | B1 | 9/2001 | Parsons et al. | |
| 6,307,328 | B1 | 10/2001 | Ko et al. | |
| 6,319,911 | B1 | 11/2001 | Rodriguez | |
| 6,347,878 | B1 | 2/2002 | Shiao | |
| 6,357,893 | B1 | 3/2002 | Belliveau | |
| 6,386,730 | B1 | 5/2002 | Matthews | |
| 6,433,551 | B1 | 8/2002 | Shaland et al. | |
| 6,474,833 | B1 | 11/2002 | Parsons et al. | |
| 6,488,390 | B1 | 12/2002 | Lebens et al. | |
| 6,585,391 | B1 * | 7/2003 | Koch et al. | 362/205 |
| 6,621,225 | B2 | 9/2003 | Bruwer | |
| 6,791,480 | B1 | 9/2004 | Uke | |
| 6,984,900 | B1 | 1/2006 | Bruwer | |
| 7,125,140 | B2 * | 10/2006 | Koch et al. | 362/205 |
| 7,186,000 | B2 | 3/2007 | Lebens et al. | |
| 7,265,494 | B2 | 9/2007 | Bruwer | |
| 7,291,940 | B2 | 11/2007 | Bruwer | |
| 7,566,149 | B2 * | 7/2009 | Koch et al. | 362/390 |
| 2009/0284185 | A1 * | 11/2009 | Koch et al. | 315/313 |

OTHER PUBLICATIONS

Subminiature Push Button Switch TS-6060 Series, Switch Channel.com, http://www.switchchannel.com/switch/131.htm, May 19, 2000.

DPN Series—Pushbutton, http://www.dnagroup.com/cgi-bin/dna/detail.cgi?O00886439, May 19, 2000.

DPC Series—Pushbutton, http://www.dnagroup.com/cgi-bin/dna/detail.cgi?O00638103, May 19, 2000.

DB Series Subminiature Snap Action Series, http://www.cherrycorp.com/switches/sadb.htm, May 19, 2000.

Light Action Pushbutton Switch, Carlingswitch, http://ww.carlingswitch.com/PRODUCTS/SWITCHES/163P.HTM, May 19, 2000.

1230 Anodization of Aluminium for Electrical Insulation (Sep. 16), http://www.finishing.com/1200-1399/1230.html p. 1-4.

Office Action issued by the United States Patent and Trademark Office for U.S. Appl. No. 10/460,047 dated Mar. 8, 2005.

Office Action issued by the United States Patent and Trademark Office for U.S. Appl. No. 10/460,047 dated Oct. 27, 2005.

Notice of Allowance issued by the United States Patent and Trademark Office for U.S. Appl. No. 10/460,047 dated Jun. 8, 2006.

Office Action issued by the United States Patent and Trademark Office for U.S. Appl. No. 11/520,051 dated Jun. 8, 2007.

Office Action issued by the United States Patent and Trademark Office for U.S. Appl. No. 11/520,051 dated Dec. 11, 2007.

Notice of Allowance issued by the United States Patent and Trademark Office for U.S. Appl. No. 11/520,051 dated Dec. 2, 2008.

Notice of Allowance issued by the United States Patent and Trademark Office for U.S. Appl. No. 11/520,051 dated Mar. 23, 2009.

Office Action issued by the United States Patent and Trademark Office for U.S. Appl. No. 12/509,628 dated Oct. 18, 2010.

* cited by examiner

MULTI-FUNCTIONAL FLASHLIGHT

CROSS-REFERENCE TO RELATED APPLICATIONS

This is a continuation of application Ser. No. 12/510,090 filed Jul. 27, 2009 and of application Ser. No. 12/509,628 filed Jul. 27, 2009 now abandoned which are continuations of Ser. No. 11/520,051, filed Sep. 11, 2006 now U.S. Pat. No. 7,566,149, which is a continuation of application Ser. No. 10/460,047, filed Jun. 12, 2003 now U.S. Pat. No. 7,125,140 B2, which is a continuation of Ser. No. 09/583,349, filed May 31, 2000 now U.S. Pat. No. 6,585,391 B1, the entire contents of which are expressly incorporate herein by reference.

BACKGROUND OF THE INVENTION

The present invention relates generally to portable illumination devices, and more particularly, but not entirely, to flashlights with enhanced functionality and reliability.

Flashlights and other portable illumination devices are very useful devices that include an illumination source as part of an electrical circuit incorporating one or more batteries (to supply current to the illumination source) and a switch to complete or interrupt the circuit. Typically, manually operated mechanical switches which have been designed for the mechanical sturdiness have been used as flashlight switches, such as the switch disclosed in U.S. Pat. No. 4,286,311 (granted Aug. 25, 1981 to Maglica), which is hereby incorporated by reference. The function of a switch in previously available flashlight has been limited to completing or interrupting the electrical circuit to the illumination source.

The switch used in the '311 patent is a push-button switch featuring a rotary contact, which is rotated axially when the button is depressed, "wiping" across stationary contacts that complete the circuit with the lamp and the batteries, in order to clean those surfaces. This is done to overcome the problems of oxidation and buildup of dirt on the electrical contacts, occurrences which increase electrical resistance in the circuit and thus undesirably limit the current flow to the illumination source.

As a result, the previously available switches require that the switch be activated with enough force to clean the contacts and rotate, or otherwise move cleaning components. The preciously available flashlights using such switches thus require an amount of force large enough to provide the "wiping" effect. A MAGLITE(R) flashlight, believed to be a market embodiment of the device represented in the '311 patent, requires a mass of over 1270 grams to latch the '311 type-switch closed when the weight was applied to the pushbutton on the flashlight until the switch was triggered. Moreover, the '311 type-switch had a stroke distance of over 5 mm to the latching position. This large force and long stroke distance may be difficult for a person with small hands to use while grasping the flashlight, or a person with reduced hand strength, as from an arthritic hand condition.

It is commonly accepted in the industry as true that the large amount of force and distance required to operate the switch, and the audible "click" that accompanies its function, may also serve as a way to prevent the switch from being accidentally operated, as inside a backpack, or toolbox.

Additionally, a switch structure like that shown in the '311 patent provides simply a way for the circuit of the flashlight to open and close, it does not provide a structure by which additional electrically based functions can be easily added to the flashlight.

It is noteworthy that none of the known prior art provides a portable illumination device with a switch that requires very little force to operate, or a short stroke distance to operate, or a switch which combines the features of needing little force to operate or needing a short stroke distance to operate, with the ability to integrate additional electronic functions within the switch structure.

The available art is thus characterized by several disadvantages that are addressed by the present invention. The present invention minimizes, and in some aspects eliminates, the above-mentioned shortcomings and other problems, by utilizing the methods and structural features described herein.

BRIEF SUMMARY OF THE INVENTION

It is therefor an object of the present invention to provide a portable illumination device that is easy to use.

It is another object of the present invention to provide a portable illumination device that requires a small amount of pressure to operate a switch mechanism which turns the device on and off.

It is a further object of the present invention to provide a portable illumination device with a switch which requires little movement of a user's finger, and requires less movement than the previously available devices, to operate the device between an operational state and an inactive state.

It is an additional object of the present invention to provide a portable illumination source that is capable of multiple functions, which are controlled by a single switch.

It is a further object of the present invention, in accordance with one aspect thereof, to provide a flashlight which can include multiple functions actuated by a single switch.

It is another object of the present invention to provide a portable illumination device with increased reliability.

It is an additional object of the invention, in accordance with one aspect thereof, to provide a metal flashlight which has an electrically resistive coating provided on the flashlight for improved appearance or protection with the flashlight also including structures to improve electrical conductivity through the flashlight.

The above-recited objects, and other objects not specifically recited, are realized in a specific illustrative embodiment of a flashlight and flashlight electrical connectors as described herein. The flashlight described herein includes a subminiature pushbutton switch that requires a small amount of pressure and a short stroke distance to operate between an open mode (electrically non-conductive) and a closed mode (electrically conductive).

The switch is preferably attached to a member on which an electrical connective structure is disposed. This preferred structure can be carried out by attaching the switch to a printed circuit board. Electrically conductive springs are also preferably attached to the member, so as to make electrically conductive contact with the electrically connective structure.

The member and the switch are preferably protected by a housing, such that the compressive force of the springs (preferably a first spring and second spring) is absorbed and resisted by the housing. In one preferred embodiment of the invention, one spring makes electrically conductive contact with an illumination source, such as an incandescent lamp, or the electrically conductive structures leading to the lamp. The second spring makes electrically conductive contact with a battery, or a electrically conductive structure leading to a battery. A conductive strip is preferably provided to complete the electrical circuit.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE PREFERRED EMBODIMENTS OF THE PRESENT INVENTION

Figure 1:
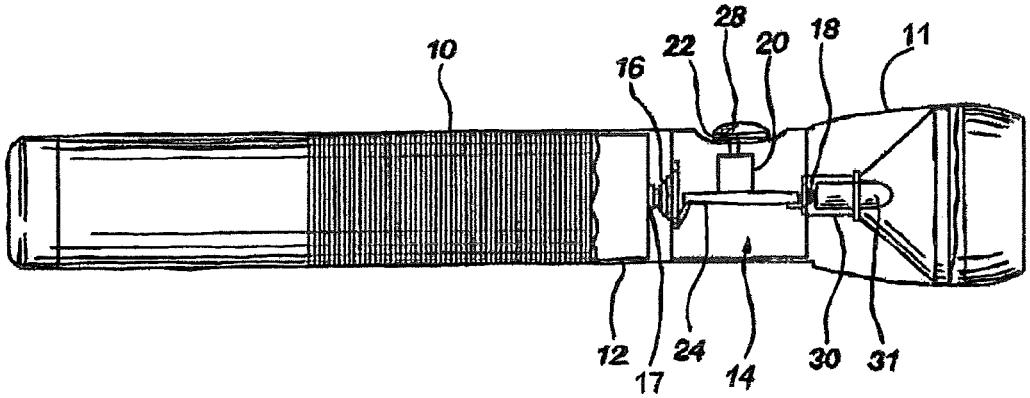
FIG. 1 is a side, partially cut away view of a flashlight made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Referring now to FIG. 1, FIG. 1 shows a flashlight made in accordance with the principles of the present invention. This specific illustrative embodiment will be used to explain the principles of the present invention, but it will be understood that the scope of the present invention extends beyond flashlights of the FIG. 1 design to other flashlight and portable illumination designs that may be made under the principles of the present invention. The FIG. 1 embodiment is a flashlight, with a tubular flashlight body 10 (cylindrical knurling is shown on the tubular flashlight body 10), and a flashlight head 11 that holds an illumination source 31. The head 11 preferably includes structures which adjust or focus the light beam emitted by the flashlight, or includes structures which provide an adjustable beam. It is also within the scope of the present invention to provide the head 11 with a plurality of lenses, structures for changing the color of the light beam emitted therefrom, or any other similar and desirable feature known, or readily ascertainable to those skilled in the art.

Figure 2:
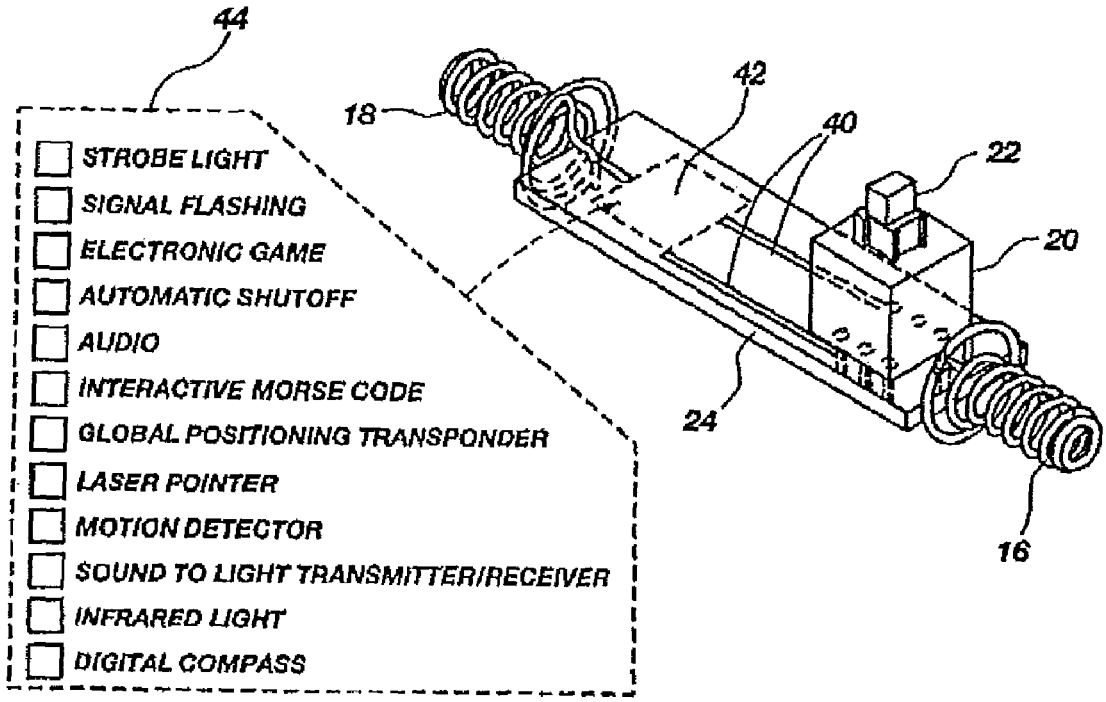
FIG. 2 is a perspective view of the switch structure portion of the flashlight FIG. 1.

As shown in the embodiment of FIG. 1, the present invention includes a unique switch structure for use in a portable illumination device. In this embodiment, the switch structure features a switch 20 attached to a member 24. The details of the switch structure are shown in FIG. 2. Preferably, the switch 20 is manually actuated by the hand of the user of the portable illumination device. The switch 20, is most preferably a subminiature pushbutton type of switch, although it is understood that other types of switches may be used. Examples of the preferred switch types which can be used to carry out the functions of the switch 20 include miniature pushbutton switches, subminiature pushbutton switches, microswitches and toggle switches.

While other types of switches may be used, the preferred switch is a double push-double pole switch which increases the reliability of the switch structure, by providing dual connections for each position in which the switch may be operably actuated. This increases the reliability of the switch over that found in the prior art, by providing dual paths along which current can travel to complete the circuit of the portable illumination device. Should oxidation, or dirt cause one pathway to become less conductive, contact may still be made across the second pathway provided by the preferred switch.

In preferred embodiments of the present invention, the switch 20 requires a small amount of force to actuate. This force is defined herein in units of gram force (gf). A gram force is equivalent to the force exerted by gravity on a mass of a gram at the earth's surface. The force used to actuate the switch 20 as used in this detailed description, and the claims consists of the force used to actuate the switch 20 in the absence of the flexible outer cap (shown in FIG. 1 at 28). In one embodiment of the present invention, the switch 20 requires less than about 1000 gf to be operably actuated. In the preferred embodiments, the switch 20 requires from about 50 gf to about 500 gf to operate, in the more preferred embodiments, the switch 20 requires from about 75 gf to about 300 gf to operate, in the most preferred it requires from about 100 gf to about 275 gf to operate.

As discussed above, the force required to actuate the switch 20 preferably used in the embodiments of the present invention is greatly reduced when compared to the force required to operate the switches presently used in portable illumination devices. This allows a device made in accordance with the principles of the present invention to be used by users who have reduced hand strength, as from an arthritic condition, and provides a significant advantage over the prior art.

Another feature of the preferred switch 20 is the reduction of the stroke distance that the switch requires to operate. A preferred pushbutton type of switch has two positions, a momentary position and a latching position. When the plunger 22 of the switch is fully depressed from the open position to the momentary position, this is referred to as the full stroke, and when the plunger is depressed from the latching position to the momentary position, this is referred to as the locking stroke. In a preferred embodiment, the full stroke of the switch 20 requires the plunger 22 to move less than about 4.0 mm. In the more preferred embodiments, the full stroke is between about 0.5 mm to about 3.75 mm, and in the most preferred it is from about 1.0 mm to about 2.75 mm. The locking stroke distance of the preferred embodiment is less than about 2.0 mm. As discussed above, these stroke distances represent a decrease over those currently used in the prior art devices, and allow a user with reduced hand strength, or a small hand size to operate a portable illumination device made in accordance with the present invention. One preferred switch 20 which may advantageously be used in the embodiments of the present invention is available from E-Switch of Brooklyn Park, Minn. serial no. TL 2201 (DPDT) EE.

The switch 20, is attached to a member 24. In this embodiment, the member 24 is planar, but it may be constructed with any alternative shape that may be used to carry out its function. The member 24 preferably has associated with it structures which carry out the function of a means for making an electrical connection, such structures being represented by electrically conductive paths 40, as will be explained more fully below. The preferred structure for the member 24 is a printed circuit board, as can be readily fabricated by those skilled in the art, with the electrically conductive paths 40, preferably carried out as circuit traces formed on the printed circuit board, and carrying out the function of the means for making an electrical connection.

The embodiment of the present invention may desirably include a functional circuit, or a plurality of functional circuits, represented in FIG. 2 as at box 42 with the functional circuits which may be included in the box 42 being represented at 44 in FIG. 2. It will be understood that no functional circuit, a single functional circuit, or a plurality of functional circuits can be included in a single embodiment of the present invention and all are intended to be included within the scope of the present invention. The functional circuits 42 and 44 serve as one example of a means for providing an additional electrical function to the flashlight. It will be appreciated that many different structures can be arrived at by those skilled in the art using the information provided herein to fabricate the functional circuits within the scope of the present invention.

Possible additional electrical functions that may be added to a portable illumination device made in accordance with the present invention include a strobe light function, a signal flashing function, an electronic game, a automatic shutoff function, audio functions, interactive Morse code, a global positioning transponder, a laser pointer, a motion detector, a sound to light transmitter/receiver, an infrared light, a digital compass function, or any other additional electrical function. It will be appreciated that the present invention encompasses within its scope the inclusion of additional structures necessary to add such functions.

It will be further appreciated that in an embodiment utilizing a double push-double pole switch, multiple functions can be controlled using the same switch. It may be preferable to design the circuitry of the additional functions such that multiple pushes on the switch control different features. For example, a single push may activate the flashlight beam, while a two pushes activates an additional function such as a strobe feature and three pushes activates another additional function, such as a motion sensor. This technique could be used to control a large number of functions, the momentary and the latching positions of a pushbutton switch could be utilized in such control. Use of a switch with additional push features would allow for the control of even a larger number of functions. Alternatively, toggle switches, other types of switches, or multiple switches may be used to control the additional functions.

A strobe light feature incorporated into the embodiments of the invention preferably provides the feature of setting the illumination source to flash at a predetermined rate, or rates. Alternatively, the strobe light feature could have an adjustable rate. This feature would allow a portable illumination device with this feature to be used as an illumination source, and as a strobe light for checking moving or rotating, equipment at remote locations.

A signal flashing feature is preferably included to have the portable illumination device flash a signal pattern, such as an SOS signal in Morse code, or another such signal, to be used as a safety or communications device. An electronic game is optionally incorporated into the device as an amusement feature, for entertaining a user, such as a child on a camping trip.

An automatic shutoff feature preferably comprises a timer that automatically shuts off the flashlight after a predetermined period. This feature would eliminate the need for an audible "click" and a large amount of force to warn the user that the device has been actuated. This function could prevent the battery from being drained, should the device be accidentally actuated, as in a backpack or toolbox, even if the user is not aware that the device has been actuated. This ability to perform the same end result without requiring additional user action represents a desirable improvement over the prior art.

An interactive Morse code feature, or a sound to light transmitter/receiver, is preferably included to allow the portable illumination device to function as a communication device. Additional structures such as speakers, lenses, or photoelectric eyes can be included to realize these functions and portable illumination devices with such structures are also included within the scope of this invention.

A global positioning (GPS) transponder, or a digital compass, is also optionally included as an additional electrical function. Such features would allow the flashlight to be used for surveying, orienteering, camping, backpacking or hiking while reducing the amount of equipment that needs to be carried. Additional structures and means such as light emitting diodes, or liquid crystal displays can be installed in the surface of a portable illumination device with such features to allow the use of such features, and inclusion of such devices are encompassed within the scope of the present invention.

A motion detector is preferably included in the embodiments of the present invention which allow a portable illumination device to be used as a motion sensitive illumination device, or as a makeshift burglar alarm in a remote location, such as while camping. An infrared light or a laser pointer could also be included and controlled as an additional feature, allowing the portable illumination device to be used as a pointer, marker, or heater. The installation of additional structures necessary to accomplish these functions is also included within the scope of the present invention.

Audio features, such as beeping to indicate that a function has been activated can also preferably be incorporated into embodiments of the present invention. Inclusion of an audio transducer, namely a speaker, to provide for audio features is also included within the scope of the present invention.

As shown in FIGS. 1 and 2, one embodiment of the present invention includes the feature of one or more conductive springs attached to the member 24 and making electrically conductive contact with the electrically conductive paths 40. The electrically conductive paths 40 are preferred examples of structures which can be used to function as means for making an electrical connection and any structure which carries out similar or equivalent functions is intended to fall within the scope of the means for making an electrical connection. For example, while printed circuit board traces are presently preferred, any structure which performs the function of carrying electrical current is intended to come within the scope of the means for making an electrical connection.

In the pictured embodiment, there are two springs 16 and 18, which are attached at opposite ends of the member 24, and make electrically conductive contact with the electrically conductive paths 40. The springs 16 and 18 may be attached by any suitable technique, including soldering, or any other technique know to those skilled in the art.

As shown in FIG. 1, spring 16 makes electrically conductive contact with a battery 12, the terminal of the battery 12 being indicated at 17 in FIG. 1. It will be appreciated that the present invention may be constructed in various embodiments that use a single battery, or plurality of batteries, which may be of any suitable size and shape for the portable illumination device. When reference is made to a battery in this specification, the term includes multiple batteries as well as single batteries, and includes all battery types, rechargeable and single use. The term battery includes all structures capable of storing and providing electrical charge and current sufficient to operate a portable illumination device. It is preferred, however, that the batteries be of the primary cell sizes commonly referred to in the industry as D, C, AA, and AAA batteries. The conductive spring 16, thus places the switch structure in electrically conductive contact with one terminal 17 of the battery.

The second conductive spring 18, of the embodiment depicted in FIG. 1 places the switch structure in electrically conductive contact with the illumination source 31. It will be appreciated that the term illumination source includes all means for producing illumination through the use of electric current, which are suitable for use in a portable illumination device. Examples of such illumination sources include incandescent lamps (including halogen lamps), fluorescent lamps, light emitting diodes, and other solid state light emitting devices, as well as any other light emitting device known or readily ascertainable to those skilled in the art.

The embodiment shown in FIG. 1, includes a structures for holding the illumination source 31. In illustrated embodiment structure for holding the illumination source 31 is represented as a supporting collar 30. The supporting collar 30, and its associated structures, are presently preferred examples of a means for holding the illumination source. Many different structures can carry out the functions of the means for holding the illumination source and it is preferred that the structures carrying out the function of the means for holding the illumination source be electrically conductive. It will be appreciated that all structures ascertainable to those skilled in the art which are capable of performing the function of holding the illumination source, either with, or without the additional circuit completion function are included within the scope of the means for holding the illumination source of the present invention. Moreover, any structures which carry out the functions, or equivalent functions, of holding the illumination source in the proper position and which are capable of being utilized as a portion of the circuit between the illumination source 31 and the battery 12 are also intended to come within the scope of the means for holding the illumination source of the present invention.

Figure 3:
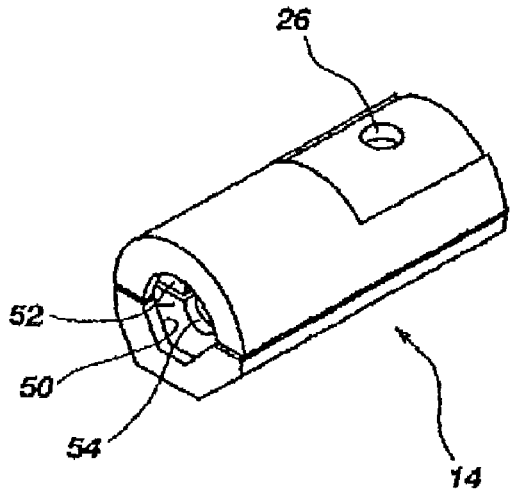
FIG. 3 is a perspective view of the switch housing structure portion of the flashlight of FIG. 1.

FIGS. 1 and 3 show a protective housing 14. In the depicted embodiment, the protective housing 14 functions to protect the switch structure from jarring, or other forces applied to the flashlight. The protective housing 14 also serves to protect the switch structure from the compressive force of the conductive springs 16 and 18. As shown in FIGS. 1 and 3, the protective housing 14 encloses the switch structure. An aperture 26, is provided for the plunger 22 to extend there through, so that the switch may be actuated. Openings 50 are provided for the conductive springs 16 and 18 to extend out from the housing 14. A wall 52 of the housing 14 lies inside the opening 50, there is a smaller opening 54 in the wall 52, through which the conductive spring 16 can make conductive contact, or be attached to the member 24. When the spring (18 in FIG. 2) is compressed, for example by the battery 12, the spring is compressed against the wall 52 of the protective housing 14. The protective housing 14 thus absorbs and resists the force of the spring compression, protecting the switch structure positioned inside the protective housing 14. It will be appreciated that other configurations of a housing capable of performing the function of protecting the switch structure are readily ascertainable to those skilled in the art, and all such structures are included in the scope of the present invention.

Figure 4:
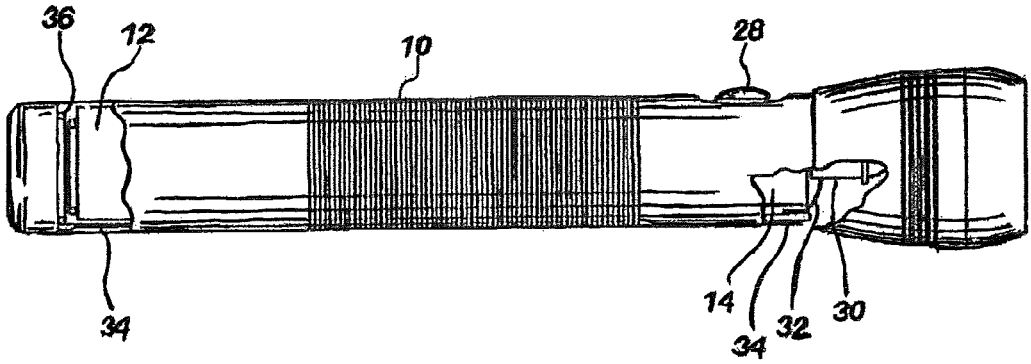
FIG. 4 is a side, partially broken away view of a flashlight made in accordance with the principles of the present invention.

FIG. 4 illustrates another preferred feature of the present invention. Many flashlights and other portable illumination devices are constructed from various metals. In these flashlights, it has been a common practice to utilize the conductive properties of the metal flashlight body to form a portion of the electrical circuit between the battery and the illumination source. An example of such a flashlight is disclosed in the '311 patent.

It has also been a common practice to treat the surface of metal flashlight bodies to provide a hardened protective surface and a finished appearance, including a color. This has been done in several ways, for example by anodizing an aluminum flashlight body, or by coating the metallic body with enamel or paint. Each of these methods of surface treatment has the effect of reducing the conductivity of the surface of the flashlight body. Anodizing aluminum, for example, is used to provide an insulative coating in aluminum conductors.

To overcome the problems of reducing the conductivity of the metal by surface treatment, several methods have been used. A portion of the anodized, or other coating may be removed by grinding, or may be covered by a mask prior to treatment, which is then removed to leave an untreated portion. These techniques produce a surface capable of conducting electricity, but in many cases the conducting ability of bare metal is reduced over time, as the metal, especially aluminum, is oxidized by the air forming a resistive coating on the metal. Another method which has been used is to coat sections of the metal with a conductive film, either over the protective coating, or over spots of metal left untreated by the other methods. While improving the conductivity, this alternate method also has drawbacks, as use wears the conductive film off electrical resistance increases, and the previously noted problems then occur.

The present invention provides a solution to this problem, with one possible embodiment which solves the described problem being represented in FIG. 4. Preferably, a conductive strip is provided to complete the electrical circuit so that the metallic flashlight body is not used to complete the circuit. In the embodiment shown in FIG. 4, a conductive strip 34 is positioned running along the inside surface of the flashlight body 10 to provide a low resistance current path. At the first end of the flashlight, the conductive strip 34, makes contact with a conductive connector 32 that is located between the protective housing 14 and the conductive strip 34. The conducive connector 32 is in contact with the supporting collar 30, allowing the illumination source to be electrically connected to the conductive strip 34. At the second end of the flashlight body 10, the conductive strip 34 makes contact with a conductive spring 36 located in the end of the flashlight body 10. The conductive spring 36, makes contact with one terminal of the battery 12. The conductive strip 34 thus completes the circuit between the illumination source 31 and the battery 12.

Figure 5:
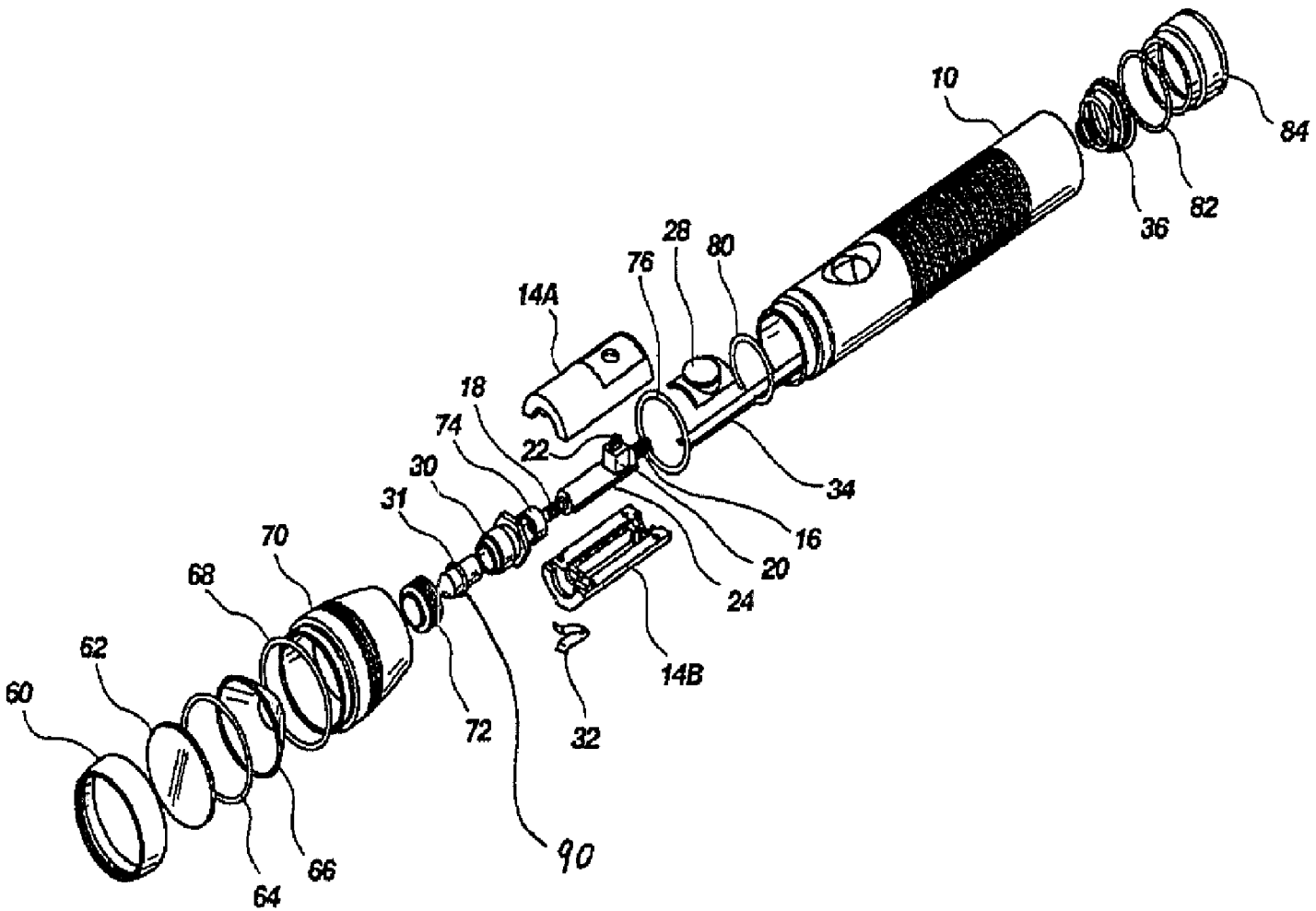
FIG. 5 is an exploded view of the embodiment shown in FIGS. 1 through 4.

It will be appreciated that portable illumination devices, including flashlights, made in accordance with the above description will accomplish some or all of the above-recited objectives of the present invention. The use of a unique switch structure results in a device with a switch that is easy to operate, may require less actuating force, can have a reduced actuating distance with increased reliability. Additional electrical functions may be included in the circuit of the device, and be controlled by the same switch structure. Additionally, the use of an internal conductive strip, allows for improved conductivity over metal flashlights with surface treatments, while still keeping the improved appearance and protection of a treated metal surface. Reference will now be made to FIG. 5, which is an exploded view of the embodiment shown in FIGS. 1-4. The following table contains an exemplary list of the parts used in this embodiment of the present invention.

REFERENCE NUMERAL STRUCTURE

60 Lens Ring
62 Lens

64 Lens O-Ring
66 Reflector
68 Head O-Ring
70 Head
72 Illumination Source Holder Ring
31 Illumination Source
30 Supporting Collar
32 Conductive connector
74 Illumination Source Insulator
18 Conductive Spring
24 Member
20 Switch
22 Switch Plunger
16 Conductive Spring
14A Protective Housing Top
14B Protective Housing Bottom
76 Retaining Ring
28 Protective Flexible Diaphragm
34 Conductive Strip
80 Lock Switch Spring
10 Flashlight Body
36 End Cap Conductive Spring
82 End Cap O-Ring
84 End Cap It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the preferred embodiment(s) of the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A flashlight comprising:

a flashlight body comprising a tube with a first end and a second end, the tube configured to hold at least one battery;

a bulb holder for holding an illumination source at the first end of the tube;

a circuit interruption and completion device forming a complete circuit between the illumination source and the battery, when the device is in a closed mode, the device comprising a switch which is manually actuated between at least a first position which causes the device to enter the closed mode and a second position, and a switch holding structure comprising a member with means for making an electrical connection associated with the member; and at least one conductive spring attached to the member to make electrical contact with the means for making an electrical connection with the battery; wherein the switch controls multiple functions of the flashlight including a strobe.

2. The flashlight according to claim 1 wherein the strobe has an adjustable rate.

3. The flashlight according to claim 1 wherein at least one additional multiple function is provided selected from the group consisting of: a signal flashing function, an electronic game, an automatic shutoff function, an audio function, an interactive Morse code function, a global positioning transponder, a laser pointer, a motion detector, a sound to light transmitter/receiver, an infrared light, and a digital compass function.

4. The flashlight of claim 1 wherein the switch is a pushbutton switch controlling the multiple functions by multiple pushes on the switch.

5. The flashlight of claim 4 wherein the pushbutton switch can further be manually actuated to establish a momentary mode of operation.

6. The flashlight according to claim 4 wherein a single push activates the flashlight beam, while two pushes activates an additional function.

7. The flashlight according to claim 6 wherein two pushes activates the strobe feature and three pushes activates another additional function.

8. The flashlight according to claim 7 wherein the another additional function is a motion sensor.

9. The flashlight according to claim 1 wherein the switch is a pushbutton switch and requires a push stroke of less than 4 mm to be operably actuated.

10. The flashlight according to claim 1 wherein the switch is a pushbutton switch and requires a push stroke between about 0.5 mm to about 3.75 mm be operably actuated.

11. The flashlight according to claim 1 wherein the switch is a pushbutton switch and requires a push stroke between about 1.0 mm to about 2.75 mm to be operably actuated.

12. The flashlight according to claim 1 wherein the switch comprises a pushbutton switch with a full push stroke distance of less than about 2.0 mm.

13. The flashlight according to claim 1 wherein the switch requires less than about 1000 gf to be operably actuated.

14. The flashlight according to claim 1 wherein the switch requires from about 50 gf to about 500 gf to be operably actuated.

15. The flashlight according to claim 1 wherein the switch requires from about 75 gf to about 300 gf to be operably actuated.

16. The flashlight according to claim 1 wherein the switch comprises a pushbutton switch requiring a force in the range from about 100 gf to about 275 gf to operate.

17. The flashlight according to claim 1 wherein the member comprises a printed circuit board.

18. The flashlight according to claim 1 wherein the means for making an electrical connection comprises a circuit formed on the printed circuit board.

19. The flashlight according to claim 1 further comprising a removable cap closing the second end of the tube.

20. The flashlight according to claim 19 wherein said spring is attached to said cap.

21. The flashlight according to claim 20 wherein the conductive spring makes contact with the means for making an electrical connection with the battery, when the cap is installed on the second end of the tube.

22. A flashlight comprising:

a flashlight body comprising a tube with a first end and a second end, the tube configured to hold at least one battery;

a bulb holder for holding an illumination source at the first end of the tube;

a circuit interruption and completion device forming a complete circuit between the illumination source and the battery, when the device is in a closed mode, the device comprising a switch which is manually actuated between at least a first closed mode and a second mode;

a switch holding structure comprising a member with means for making an electrical connection associated with the member; and at least one conductive spring attached to the member to make electrical contact with the means for making an electrical connection with the battery; wherein the switch controls multiple functions of the flashlight including a strobe.

23. The flashlight according to claim 22 wherein the strobe has an adjustable rate.

24. The flashlight according to claim 22 wherein at least one additional multiple function is provided selected from the group consisting of: a signal flashing function, an electronic game, an automatic shutoff function, an audio function, an interactive Morse code function, a global positioning transponder, a laser pointer, a motion detector, a sound to light transmitter/receiver, an infrared light, and a digital compass function.

25. The flashlight of claim 22 wherein the switch is a pushbutton switch controlling the multiple functions by multiple pushes on the switch.

26. The flashlight of claim 22 wherein the pushbutton switch can further be manually actuated to establish a momentary mode of operation.

27. The flashlight according to claim 25 wherein a single push activates the flashlight beam, while two pushes activates an additional function.

28. The flashlight according to claim 27 wherein two pushes activates the strobe feature and three pushes activates another additional function.

29. The flashlight according to claim 28 wherein the another additional function is a motion sensor.

30. The flashlight according to claim 22 wherein the switch is a pushbutton switch and requires a push stroke of less than 4 mm to be operably actuated.

31. The flashlight according to claim 22 wherein the switch is a pushbutton switch and requires a push stroke between about 0.5 mm to about 3.75 mm be operably actuated.

32. The flashlight according to claim 22 wherein the switch is a pushbutton switch and requires a push stroke between about 1.0 mm to about 2.75 mm to be operably actuated.

33. The flashlight according to claim 22 wherein the switch comprises a pushbutton switch with a full push stroke distance of less than about 2.0 mm.

34. The flashlight according to claim 22 wherein the switch requires less than about 1000 gf to be operably actuated.

35. The flashlight according to claim 22 wherein the switch requires from about 50 gf to about 500 gf to be operably actuated.

36. The flashlight according to claim 22 wherein the switch requires from about 75 gf to about 300 gf to be operably actuated.

37. The flashlight according to claim 22 wherein the switch comprises a pushbutton switch requiring a force in the range from about 100 gf to about 275 gf to operate.

38. The flashlight according to claim 22 wherein the member comprises a printed circuit board.

39. The flashlight according to claim 22 wherein the means for making an electrical connection comprises a circuit formed on the printed circuit board.

40. The flashlight according to claim 22 further comprising a removable cap closing the second end of the tube.

41. The flashlight according to claim 40 wherein said spring is attached to said cap.

42. The flashlight according to claim 41 wherein the conductive spring makes contact with the means for making an electrical connection with the battery, when the cap is installed on the second end of the tube.

43. A flashlight comprising:

a flashlight body comprising a tube with a first end and a second end, the tube configured to hold at least one battery;

a bulb holder for holding an illumination source at the first end of the tube;

a switch manually movable between a first position and a second position for interrupting and for completing an electrical circuit between the illumination source and the battery;

a switch holding structure comprising an electrically connectable member; and at least one conductive spring that is in electrical contact with the member to make electrical contact with the battery; wherein the switch controls multiple functions of the flashlight including a strobe; and the strobe has an adjustable rate.

44. The flashlight according to claim 43 wherein at least one additional multiple function is provided selected from the group consisting of: a signal flashing function, an electronic game, an automatic shutoff function, an audio function, an interactive Morse code function, a global positioning transponder, a laser pointer, a motion detector, a sound to light transmitter/receiver, an infrared light, and a digital compass function.

45. A flashlight comprising:

a flashlight body comprising a tube with a first end and a second end, the tube configured to hold at least one battery;

a bulb holder for holding an illumination source at the first end of the tube;

a circuit interruption and completion device forming a complete circuit between the illumination source and the battery, when the device is in a closed mode, the device comprising a switch which is manually actuated between at least a first closed mode and a second mode;

a switch holding structure comprising a member with means for making an electrical connection associated with the member; and at least one conductive spring attached to the member to make electrical contact with the means for making an electrical connection with the battery; wherein the switch controls multiple functions of the flashlight including a momentary mode.

46. The flashlight according to claim 45 wherein at least one additional multiple function is provided selected from the group consisting of: a strobe, a signal flashing function, an electronic game, an automatic shutoff function, an audio function, an interactive Morse code function, a global positioning transponder, a laser pointer, a motion detector, a sound to light transmitter/receiver, an infrared light, and a digital compass function.

47. The flashlight of claim 46, wherein the switch is a pushbutton switch controlling the multiple functions by multiple pushes on the switch.

48. The flashlight according to claim 47 wherein a single push activates the flashlight beam, while two pushes activates an additional function.

49. The flashlight according to claim 48 wherein two pushes activates the strobe feature and three pushes activates another additional function.

50. The flashlight according to claim 45 wherein the switch comprises a pushbutton switch with a full stroke distance of less than about 4.0 mm.

51. The flashlight according to claim 45 wherein the switch comprises a pushbutton switch which requires less than about 1000 gf to be operably actuated.

52. The flashlight according to claim 45 wherein the member comprises a printed circuit board.

53. The flashlight according to claim 45 wherein the means for making an electrical connection comprises a circuit formed on the printed circuit board.

54. A lighting device comprising:

a body configured to hold at least one battery; the body having a lamp holder for holding an illumination source;

a circuit interruption and completion device forming a complete circuit between the illumination source and the battery, the device comprising a pushbutton switch which is manually activated;

a circuit board within the circuit capable of producing multiple functions; wherein the pushbutton switch controls the multiple functions by multiple pushes on the switch.

55. The lighting device of claim 54 wherein the lighting device is a flashlight.

56. The lighting device of claim 54 wherein one of the multiple functions is a strobe having an adjustable rate.

57. The lighting device of claim 54 wherein one of the multiple functions is a momentary mode of operation.

58. The lighting device of claim 54 wherein the push force to activate the push-button switch is less than about 1000 gf.

59. The lighting device of claim 54 wherein the push stroke is less than about 4 mm.

* * * * *